US006821237B1

(12) United States Patent
Isometsäet al.

(10) Patent No.: US 6,821,237 B1
(45) Date of Patent: Nov. 23, 2004

(54) THERMOROLL FOR A PAPER/BOARD MACHINE OR FINISHING MACHINE AND A METHOD FOR MANUFACTURING THE THERMOROLL

(75) Inventors: Juha Isometsä, Jyväskylä (FI); Erkki Leinonen, Järvenpää (FI); Mika Viljanmaa, Espoo (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/937,916

(22) PCT Filed: Mar. 15, 2000

(86) PCT No.: PCT/FI00/00204

§ 371 (c)(1),
(2), (4) Date: Jan. 22, 2002

(87) PCT Pub. No.: WO00/58554

PCT Pub. Date: Oct. 5, 2000

(30) Foreign Application Priority Data

Mar. 29, 1999 (FI) ..... 990691

(51) Int. Cl.[7] ..... B23P 15/00
(52) U.S. Cl. ..... 492/46; 165/89
(58) Field of Search ..... 492/46, 54, 56; 165/89, 90, 180; 34/124; 162/206; 432/246

(56) References Cited

U.S. PATENT DOCUMENTS

| | | | | | |
|---|---|---|---|---|---|
| 4,261,112 | A | * | 4/1981 | Apitz | 34/119 |
| 5,252,185 | A | * | 10/1993 | Ellis et al. | 162/206 |
| 5,369,884 | A | * | 12/1994 | Chen | 29/895.32 |
| 5,967,958 | A | * | 10/1999 | Borkenhagen et al. | 492/46 |
| 6,032,725 | A | * | 3/2000 | Marschke et al. | 165/90 |
| 6,039,681 | A | * | 3/2000 | Heinz-Michael | 492/20 |
| 6,100,508 | A | * | 8/2000 | Kubik | 219/469 |
| 6,105,651 | A | * | 8/2000 | Leanna | 156/555 |
| 6,158,501 | A | * | 12/2000 | Koivukunnas | 165/89 |
| 6,398,700 | B1 | * | 6/2002 | Ruuska et al. | 492/20 |
| 2002/0088120 | A1 | * | 7/2002 | Laitinen et al. | 29/895.22 |

* cited by examiner

*Primary Examiner*—I Cuda Rosenbaum
(74) *Attorney, Agent, or Firm*—Steinberg & Raskin, P.C.

(57) ABSTRACT

The object of the invention is a thermoroll for a paper/board machine or a finishing machine, the said thermoroll comprising a shell (2; 4, 5) of metallic, ceramic or composite material, the shell incorporating ducts (3; 9) for passing a heating medium from one axial end of the shell to its opposite end. The shell is made by means of casting or powder metallurgical methods, and the ducts (3; 9) are formed in the matrix material of the shell which is of metal and/or ceramic, directly in connection with manufacture. A further object of the invention is a method for manufacturing a thermoroll.

9 Claims, 6 Drawing Sheets

THERMOROLL FOR A PAPER/BOARD MACHINE OR FINISHING MACHINE AND A METHOD FOR MANUFACTURING THE THERMOROLL

The object of the present invention is a thermoroll for a paper/board machine or a finishing or converting machine, the said thermoroll comprising a shell of metallic, ceramic or composite material, the shell incorporating ducts for passing a heating medium from one axial end of the shell to its opposite end.

A further object of the invention is a method for manufacturing a thermoroll for a paper/board machine or a finishing or converting machine, the said thermoroll comprising a shell of metallic, ceramic or composite material, the said shell incorporating ducts for passing a heating medium from one axial end of the shell to its opposite end.

Heatable rolls, that is, thermorolls, are commonly used in paper machines and paper finishing or converting machines, especially in calenders and multi-roll calenders, the length of the said thermorolls being as much as 10 m, their diameters being typically of the order of approximately 500–1000 mm—with soft calender rolls 1200–1650 mm. The heating of the rolls is usually carried out by means of a heating medium, such as steam or hot water or oil. Thermorolls are typically formed by drilling axial bores close to the outer surface of the roll shell, the diameter of the bores being typically about 25–50 mm, and through which bores the heating medium is passed from one axial end of the roll to its opposite end. There are typically several such bores, distributed evenly in the circumferential direction of the roll. The heating medium may circulate in the bore, for example, once from one end of the roll to the other, or twice or several times so that in adjacent bores, the heating medium travels in opposite directions. FIGS. 1 and 2 show a prior art thermoroll of this type, in which a shell 2 is attached to end flanges 16, 18 provided with axle journals 15, 17, in which shell are formed axial bores 3, of which there are several, distributed evenly in the circumferential direction. In the axle journal 15 is formed an axial bore 14, to which is fitted a pipe 11 extending to the opposite end flange 18. Between the outer surface of the pipe 11 and the interior surface of the axial bore 14 remains an annular slot. The heating medium is supplied to the roll 1 from the first end (the end with the axle journal 15) through a pipe 11 and passed via the radial bores 12 at the opposite end to the bores 3, and along them back to the first end, and via the radial bores 13 to the said annular slot in the axle journal 15 and from there out of the roll.

A problem associated with thermorolls provided with this type of prior art bores relates to making the axial bores by means of long hole drilling, which is relatively slow and expensive. Long hole drilling is made particularly demanding by the formation of material structure boundary surfaces in the wall construction of the shell due to the manufacturing technique. The cementite microstructure in chill cast thermorolls is brittle and susceptible to breakage due to the effect of mechanical and thermal loads. Variation in the thickness of the cementite layer may in addition cause curving of the rolls when heated. Intergranular corrosion may also occur due to paper auxiliaries. Furthermore, the current trend towards increasingly high temperatures increases the problems caused by the thermal fatigue of materials. To improve wear resistance, chilled rolls have to be coated, for example, by hard chromium plating.

Thus, one of the aims of the present invention is to achieve an improved thermoroll, where long hole drilling and other prior art disadvantages are avoided. The aim is, moreover, to achieve a roll, where good heating properties are obtained for the outer surface of the roll. To achieve this aim, it is characteristic of the thermoroll relating to the invention that the shell is made by means of casting or powder metallurgical methods, and that the ducts are formed in the matrix material of the shell which is of metal, ceramic or a composite, directly in connection with manufacture. Other preferred embodiments of the thermoroll relating to the invention are described in dependent claims 2 to 11.

Of the method relating to the invention for manufacturing a thermoroll it is, on the other hand, characteristic that the shell is made by means of casting and/or powder metallurgical methods, and that the ducts are formed in the matrix material of the shell which is of metal, ceramic or a composite, directly in connection with manufacture, without machining. Other preferred embodiments of the method relating to the invention are described in dependent claims 13 to 17.

The invention is described in the greater detail in the following, with reference to the appended drawings in which:

FIGS. 1 and 2 show a diagrammatic view of the prior art thermoroll disclosed in the introduction.

Figure 1:
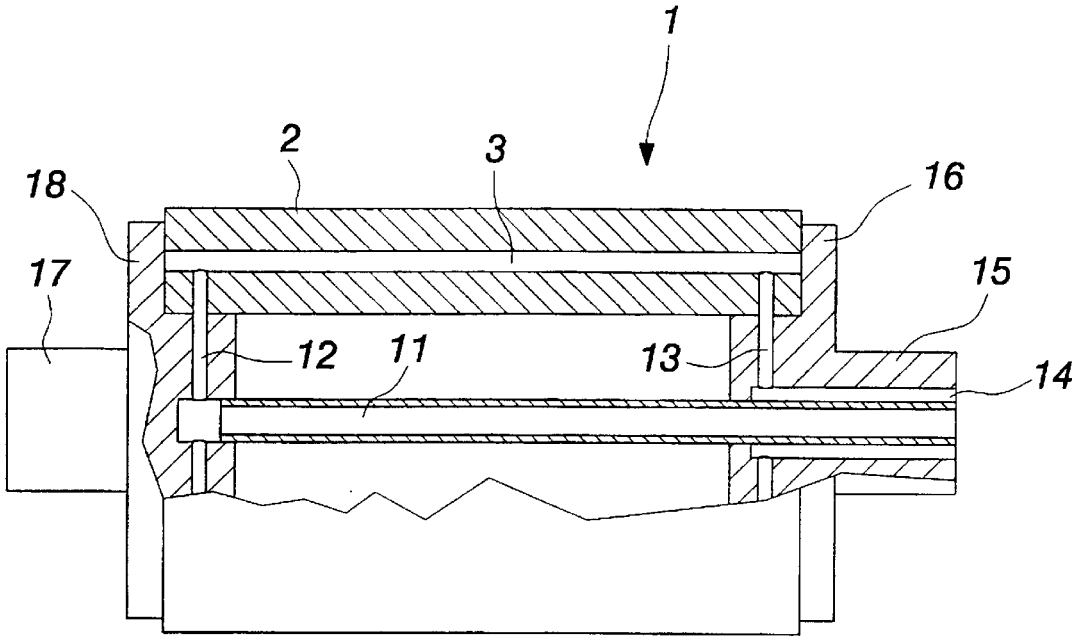
Fig.1 (prior art)
FIGS. 1 and 2 show diagrammatically a prior art thermoroll solution.
Figure 2:
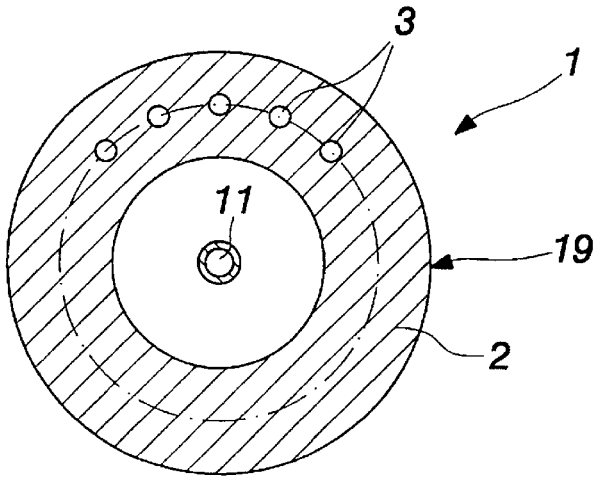
Fig.2 (prior art)
Figure 3:
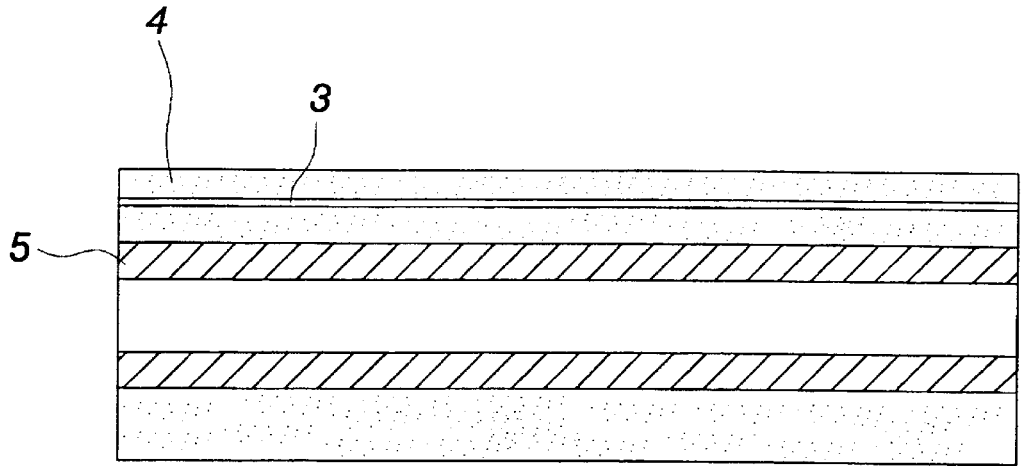
FIGS. 3 to 10 show diagrammatic views of examples of different embodiments of the invention.

FIG. 3 shows a thermoroll implemented in accordance with the invention as a diagrammatic longitudinal section, in which an outer shell 4 made of metal in powder form and incorporating a heating medium duct 3 is formed around an inner base tube 5 of steel or cast iron. The metal powder is metal in spherical particulate form and having a particle diameter of the order of 0.1–0.5 mm, which is made of molten metal by means of gas atomisation. It may be more alloyed than composition metals produced by conventional methods, and it may also contain carbide and oxide components, such as, for example, Al, B, Cr, Ti, Si, Sn, W, Zn, Zr oxides and carbides or their alloys. To produce a piece of metal powder, powder metallurgical methods can be used, which include spraying, extrusion and hot isostatic pressing (HIP). In the HIP method, for example, a piece of metal obtains its final form and density under a high pressure and temperature, the metal remaining, however, in a non-molten state, whereby the properties obtained for the product are better and more homogeneous than those of products obtained when using melting methods.

Figure 10A:
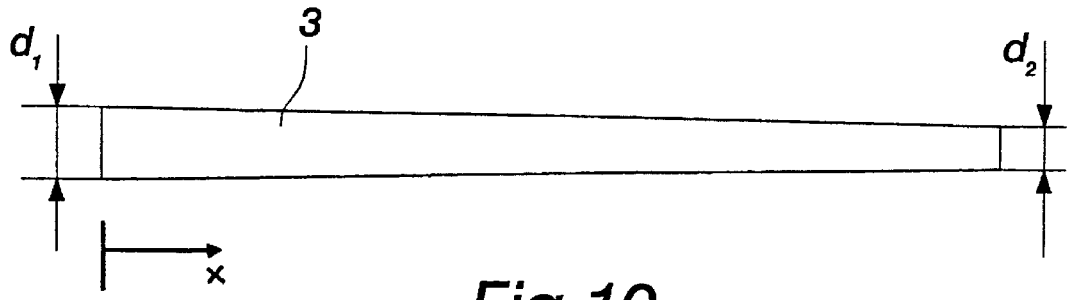
Figure 10B:
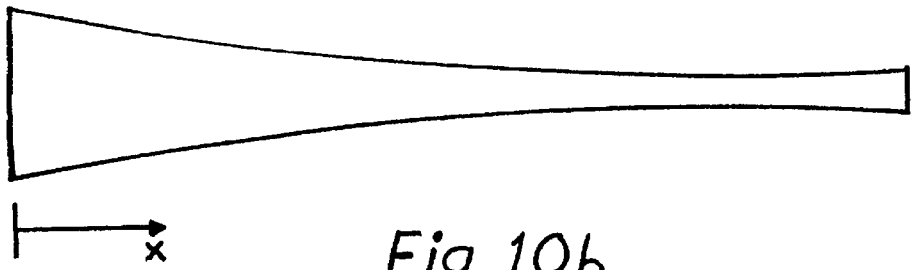

In the embodiment relating to FIG. 3, the heating medium ducts 3 are formed in the outer shell layer of metal powder as pipes with a sheet metal structure, the said pipes acting as a mould during the manufacturing process. The pipes may be left inside the shell layer 4. When manufacturing the outer shell layer 4 by means of HIP treatment, a sheet metal capsule is formed around the inner manifold 5 at a distance corresponding to the desired thickness of the outer layer, inside which capsule is placed metal powder around the heating duct pipes 3. After this air is sucked from the capsule almost to a state of vacuum and the capsule is subjected to a high pressure and temperature, thus effecting the formation of the final outer layer 4 of the shell. The sheet metal pipe structures forming the heating medium ducts can be designed, for example, as shown in FIG. 10, whereby the use of separate displacing elements causing local temperature differences in the axial direction of the roll can be avoided. The use of such displacing elements is described, for example, in FI patent 91297. The flow duct can be designed either so that its diameter changes linearly (10*a*), or in optimised form producing a constant heat flow q(x) (FIG. 10*b*).

Figure 4:
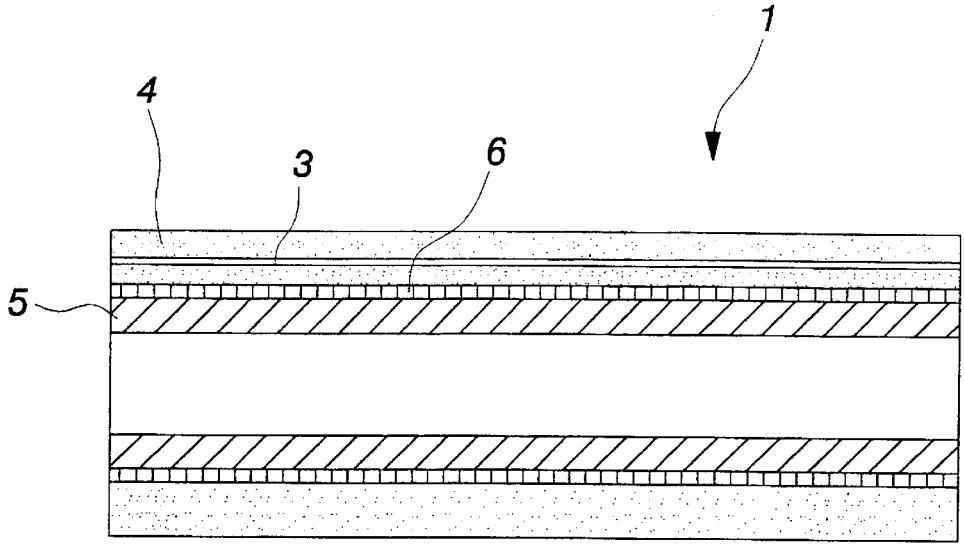

The outer shell layer 4 can also be made separately from the inner shell and be attached to the inner shell, for example, by means of shrink fitting technique or by glueing or soldering the shells together. FIG. 4 shows the structure of a shell obtained in this manner, in which there is a bonding layer 6 between the inner shell layer 5 and the outer shell layer 4 made of metal powder. This bonding layer 6 can also be thought to be formed as an insulating layer in order to improve the heating properties of the thermoroll on the outer surface of the roll shell.

Figure 5:
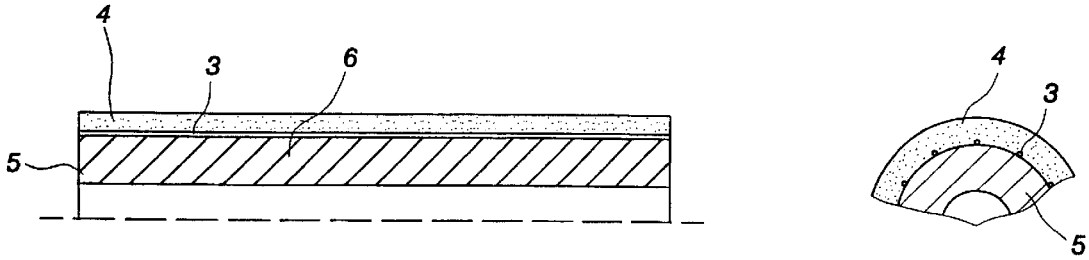

The heating medium ducts 3 may also be located, for example, as shown in FIG. 5, on the boundary surface between the inner frame shell and the outer shell of metal powder. The heating medium ducts may be conventional axial ducts or pipes, or they can also be made to run spirally on the circumference of the shell.

Figure 6:
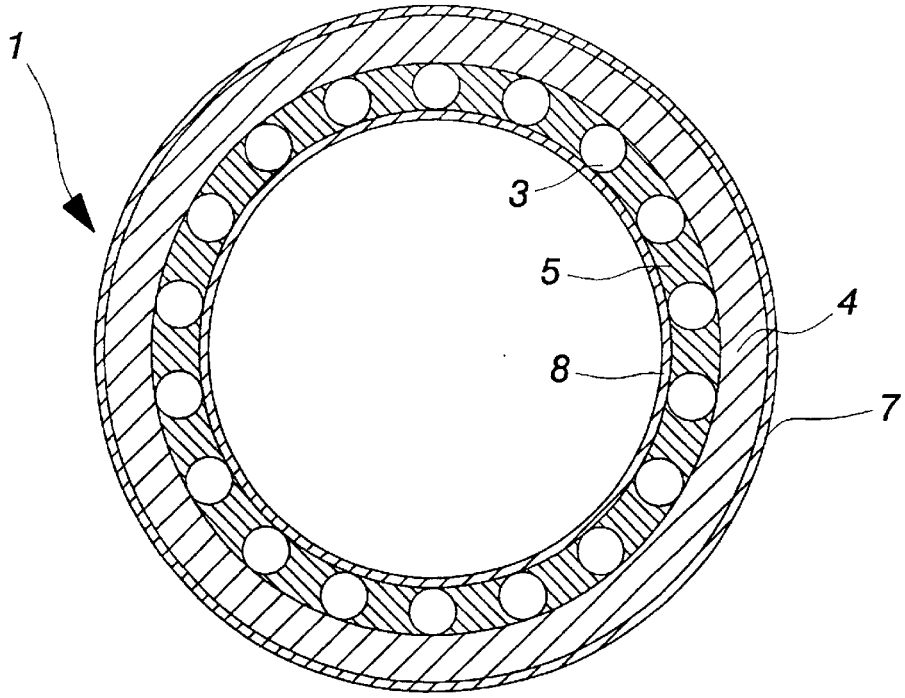

FIG. 6 shows a cross-section of a thermoroll, which comprises an inner pipe.8 made of material having low thermal conductivity (heat insulator), on top of which pipe are attached smaller pipes 3 which act as heating medium ducts in the roll. After this, an outer layer 4 of material 5 having a better coefficient of thermal conductivity, or possibly of material with even better thermal conductivity, is cast over the inner pipe 8 and the ducts 3 attached to it, or made by means of pulverisation-metallurgical methods. Finally, the roll is coated with a hard and wear-resistant coating 7. Material layers 5 and 4 may also both be of the same material and they can be manufactured in one stage.

Figure 7:
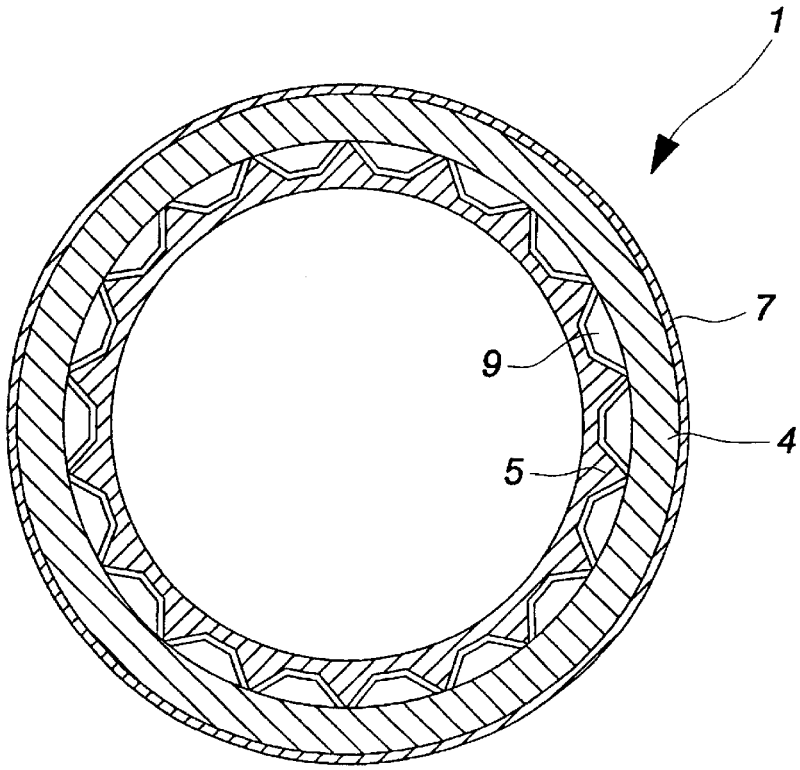

FIG. 7 shows a solution in which ducts 9, for example a duct system bent from sheet metal, on the inside of which is formed, for example by casting, a base material layer 5 of e.g. cast iron, are formed on the inner surface of the outer shell layer 4 which is of a material having better thermal conductivity. There may also be an insulating layer on the inner surface of the inner layer 5.

Table 1 shows some approximate material values of materials which can be used in the method relating to the invention.

| Material | Thermal conductivity [W/mK] | Fatigue strength [MPa] | Density [kg/m$^3$] | Module [GPa] |
|---|---|---|---|---|
| Cast iron | 50 | 80 | 7300 | 100–130 |
| Al/SiC composite | 175 | 250 | 2600 | 90–110 |
| Coal/Coal composite | 200–250 | 100–500 | 1600 | 90–120 |

By selecting the materials so that their thermal conductivity increases when moving from the inner shell layer to the outer shell layer, a higher roll surface temperature is achieved with less energy, which may lower the total costs incurred by the thermoroll. The roll structure can, moreover, be lightened, which results in cost savings especially in multi-roll calenders (such as OptiLoad calenders).

Figure 8:
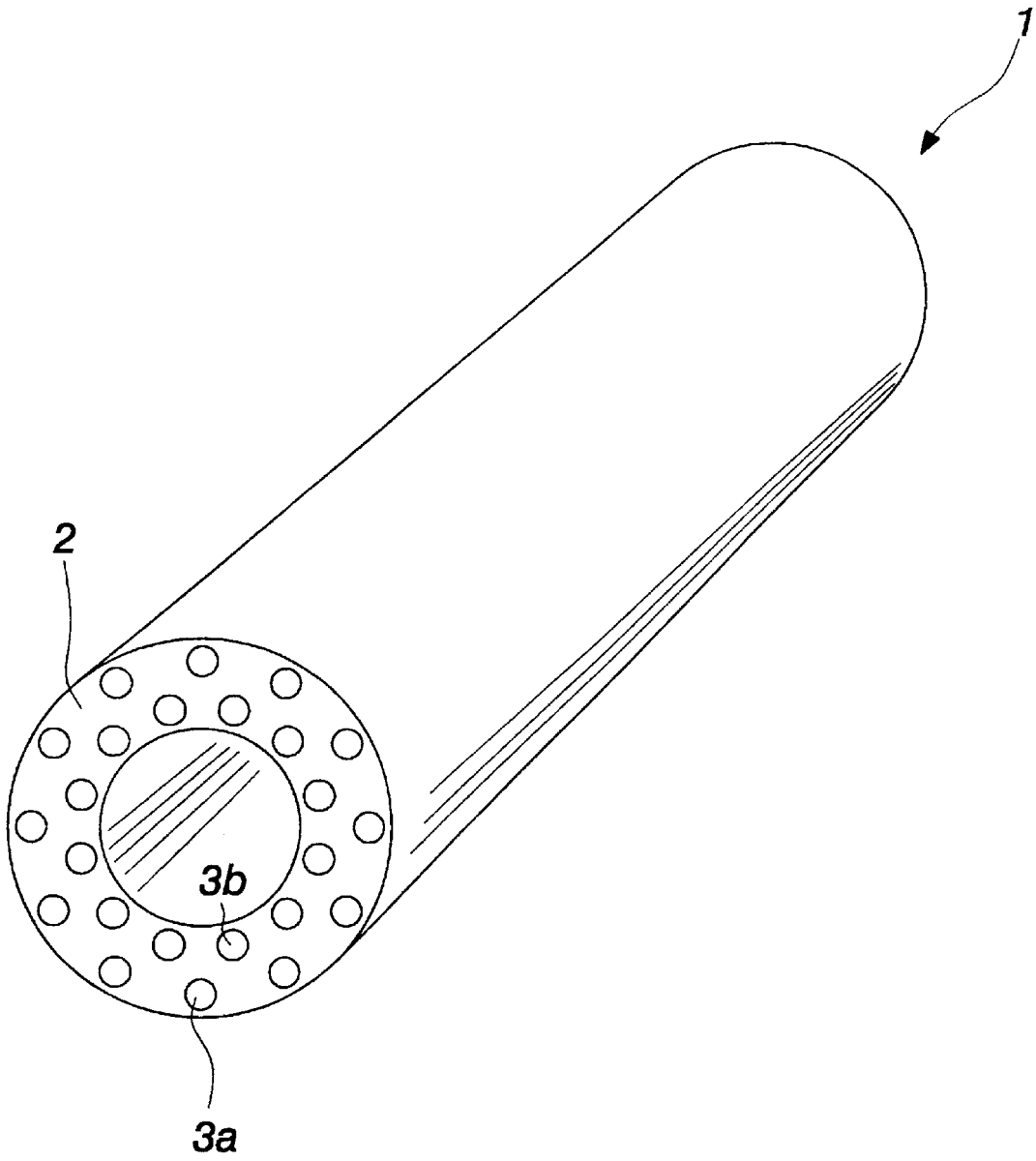

FIG. 8 shows a solution in which the entire shell body is formed of a metal powder alloy, which is produced by means of HIP treatment and in which alloy are formed heating medium ducts 3*a*, 3*b* on two different radial levels in the shell material. If necessary, also on the inner surface of this roll may be formed an insulating layer and the outer surface can be coated with a hard and wear-resistant coating, for example, with a ceramic material which is sprayed onto the outer surface of the shell.

Figure 9:
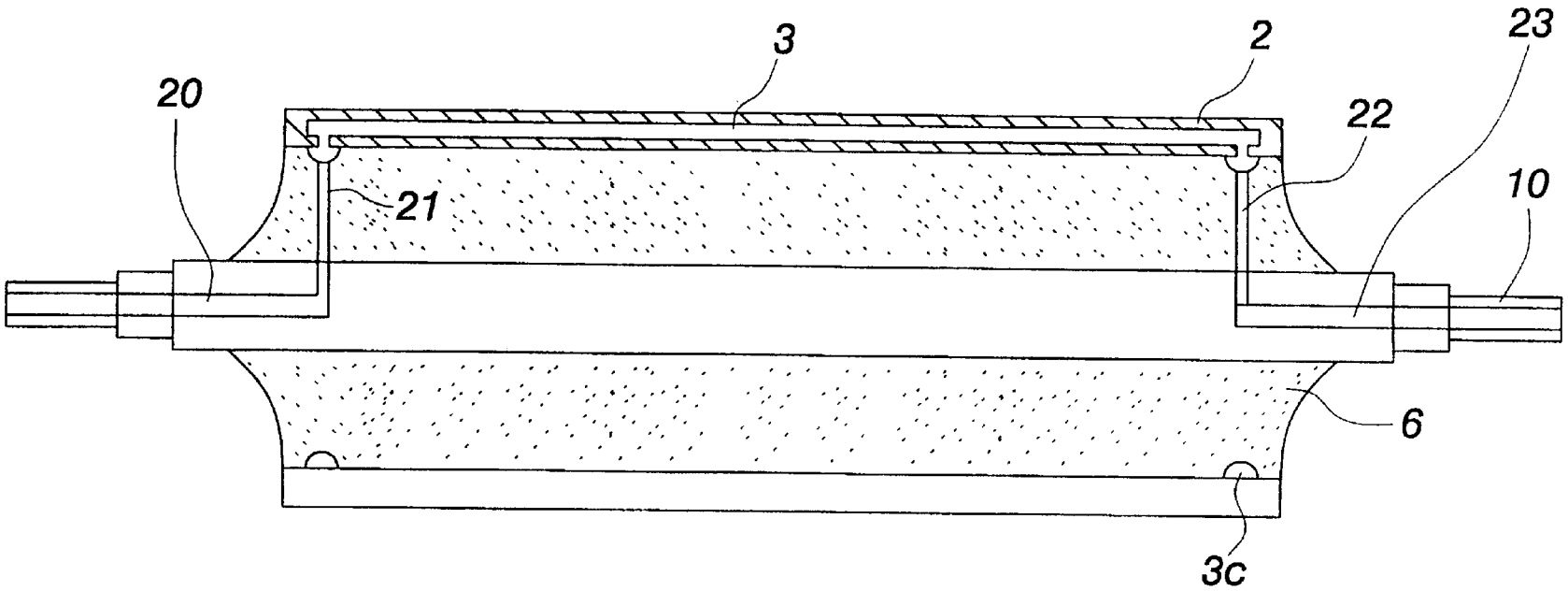

FIG. 9 shows a thermoroll construction implemented without the end flanges. In this solution, the axle 10 made of steel or cast iron acts as an internal mould for the intermediate shell 6, the composition of which intermediate shell can be selected from materials with a light density, such as aluminium-based powdered compositions. The heating medium feed and discharge ducts 20, 23 are formed by means of bores made in the axle, and in the intermediate shell 6 are formed radial ducts 21 and 22 for supplying the heating medium to the outer shell layer 2, which comprises axial heating medium ducts 3. This outer shell 2 can be made as a separate pipe and then be attached over the intermediate shell 6, or the intermediate shell can be used as a mould around which the outer shell 2 is made, for example, by means of HIP treatment.

When the roll is made in accordance with the invention, optimisation of the heat transfer ducts in the longitudinal direction of the roll is possible. Holes may be placed more densely and their diameters may be smaller than those of drilled holes. The ducts do not necessarily have to be parallel with the roll axle, but may be, for example, spiral or oblique to reduce barring. Change of the diameter of the ducts in the axial direction is also easy to arrange without separate displacing elements. Especially when applying powder metallurgy, the surface of the roll can be made of material alloyed in a different manner in connection with the manufacture of the shell, whereby wear resistance can be improved without hard chromium plating or other separate coating stage. Products made by means of powder metallurgical methods are more homogenous and more controlled, which means that in critical conditions their operational safety improves.

What is claimed is:

1. A thermoroll for a paper/board machine or a finishing machine, comprising:

a shell of metallic, ceramic or composite material, the shell incorporating ducts for passing a heating medium from one axial end of the shell to its opposite end;

wherein the shell is made by means of one of casting powder metallurgical methods or combinations thereof, and that the ducts are formed in the shell directly in connection with manufacture of said shell, the shell is being formed as a composite construction in which there are at least two different material layers in the direction of thickness of the shell, the thermal conductivity of the material layers increasing when moving from the layer on the inner surface side of the shell to the layer on the outer surface side of the shell; and wherein the ducts are situated on at least two different radial levels in the shell material.

2. A thermoroll as claimed in claim 1, wherein the ducts on the different levels are situated in a staggered manner.

3. A thermoroll for a paper/board machine or finishing device comprising:

a shell having a first inner layer and a second outer layer;

a plurality of ducts passing through said shell for passing a heating medium from a first axial end of said shell to a second axial end of said shell;

wherein said second outer layer has a thermal conductivity that is greater than a thermal conductivity of said first inner layer;

wherein the ducts are situated on at least two different radial levels in the shell material.

4. A method for manufacturing a thermoroll for a paper/board machine or finishing device comprising:

forming a shell having a first inner layer and a second outer layer arranged around said first inner layer;

forming a plurality of ducts in said shell for passing a heating medium from a first axial end of said shell to a second axial end of said shell;

wherein said second outer layer has a thermal conductivity that is greater than a thermal conductivity of said first inner layer;

wherein the ducts are situated on at least two different radial levels in the shell material.

5. A thermoroll for a paper/board machine or a finishing machine, comprising:

a shell of metallic, ceramic or composite material, the shell incorporating ducts for passing a heating medium from one axial end of the shell to its opposite end; and wherein the ducts are situated on at least two different radial levels in the shell material.

6. A thermoroll as claimed in claim 3, wherein the ducts on the different levels are situated in a staggered manner.

7. A thermoroll as claimed in claim 3, wherein the ducts are formed from one axial end of the shell to its opposite end as spirally extending pipes or ducts.

8. A method for manufacturing a thermoroll as claimed in claim 4, wherein the plurality of ducts on the different levels are situated in a staggered manner.

9. A method for manufacturing a thermoroll as claimed in claim 4, wherein the plurality of ducts are formed from one axial end of the shell to its opposite end as spirally extending pipes or ducts.

* * * * *